US007971982B2

(12) United States Patent
Suzuki

(10) Patent No.: US 7,971,982 B2
(45) Date of Patent: Jul. 5, 2011

(54) RECORDING APPARATUS AND INKJET PRINTER HAVING A CHANNEL UNIT AND MENISCUS VIBRATOR

(75) Inventor: Yoshihumi Suzuki, Ena (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/396,366

(22) Filed: Mar. 2, 2009

(65) Prior Publication Data

US 2009/0219344 A1 Sep. 3, 2009

(30) Foreign Application Priority Data

Feb. 28, 2008 (JP) ..... 2008-048527

(51) Int. Cl.
*B41J 29/38* (2006.01)
*B41J 2/18* (2006.01)
*B41J 2/19* (2006.01)

(52) U.S. Cl. ..... 347/89; 347/11; 347/92

(58) Field of Classification Search ..... 347/89
See application file for complete search history.

(56) References Cited

U.S. PATENT DOCUMENTS

| | | | | |
|---|---|---|---|---|
| 7,241,000 | B2 | 7/2007 | Hirota et al. | |
| 7,770,990 | B2 * | 8/2010 | Nagashima | 347/92 |
| 2006/0103700 | A1 | 5/2006 | Taira | |
| 2007/0115329 | A1 * | 5/2007 | Takatsuka | 347/57 |
| 2007/0139463 | A1 | 6/2007 | Chikamoto et al. | |
| 2007/0139498 | A1 * | 6/2007 | Chikamoto et al. | 347/93 |
| 2008/0218552 | A1 * | 9/2008 | Xu et al. | 347/27 |
| 2009/0179937 | A1 * | 7/2009 | Yamada | 347/17 |
| 2010/0321424 | A1 * | 12/2010 | Tamaki | 347/14 |

FOREIGN PATENT DOCUMENTS

| | | | |
|---|---|---|---|
| JP | 2005-169839 | A | 6/2005 |
| JP | 2005-238677 | A | 9/2005 |
| JP | 2006-168339 | A | 6/2006 |
| JP | 2006-224435 | A | 8/2006 |
| JP | 2007-160823 | A | 6/2007 |
| JP | 2007-268893 | A | 10/2007 |
| JP | 2009143168 | A * | 7/2009 |

OTHER PUBLICATIONS

Japan Patent Office, Notice of Reasons for Rejection for Japanese Patent Application No. 2008-048527 (counterpart to above-captioned patent application), mailed Apr. 13, 2010.
Japan Patent Office, Notice of Reasons for Rejection for Japanese Patent Application No. 2008-048527 (counterpart to above-captioned patent application), mailed Nov. 9, 2010.

* cited by examiner

*Primary Examiner* — Shelby Fidler
(74) *Attorney, Agent, or Firm* — Baker Botts L.L.P.

(57) ABSTRACT

A recording apparatus may include a channel unit including a pressure chamber configured to store a liquid, and nozzles. The recording apparatus may include a reservoir unit connected to the channel unit and including a supply port, a drain port, a supply channel communicating with the channel unit, and a drainage channel branching off from the supply channel and communicating with the outside via the drain port. The recording apparatus may include actuators configured to apply pressure to the liquid in the pressure chamber. The recording apparatus may include a meniscus vibrator configured to drive the actuators to vibrate meniscus produced in the nozzles without causing liquid droplets to be ejected therefrom when the liquid supplied from the supply port is being drained from the drain port after traveling through the supply channel and the drainage channel.

11 Claims, 11 Drawing Sheets

RECORDING APPARATUS AND INKJET PRINTER HAVING A CHANNEL UNIT AND MENISCUS VIBRATOR

CROSS REFERENCE TO RELATED APPLICATION

This application claims priority to Japanese Patent Application No. 2008-48527, filed on Feb. 28, 2008, the entire subject matter and disclosure of which is incorporated herein by reference.

BACKGROUND OF THE DISCLOSURE

1. Field of the Disclosure

The features herein relate to a recording apparatus that records an image on a recording medium by ejecting liquid droplets thereon.

2. Description of the Related Art

A known inkjet head distributes ink supplied from a supply port to a plurality of individual ink channels, which extend from pressure chambers to nozzles, via an ink supply channel and a common ink chamber. The inkjet head also apply pressure to the ink inside the pressure chambers in pulses so as to eject ink droplets from the nozzles communicating with the pressure chambers. When air gets mixed inside the ink supply channel formed in the inkjet head, the pressure waves applied to the ink in the pressure chambers cannot properly propagate through the channels. In a known inkjet head, a drainage channel that branches off from the ink supply channel to connect to a drain port is additionally provided. Through this drainage channel, the ink supplied from the supply port is enforcedly drained from the drain port so that the air mixed inside the channels is drained to the outside together with the ink.

However, in the above-described inkjet head, increasing the pressure of ink supplied from the supply port leads to an increase in the pressure of ink in the individual ink channels. This causes the ink to leak from the nozzles.

SUMMARY OF THE DISCLOSURE

A need has arisen for a recording apparatus and an inkjet printer that can efficiently remove air existing in a channel as well as reduce liquid consumption.

According to an embodiment herein, a recording apparatus may comprise a channel unit comprising a pressure chamber configured to store a liquid to be ejected, and nozzles configured to eject the liquid. The recording apparatus may further comprise a reservoir unit connected to the channel unit and comprising a supply port to which the liquid is supplied from an outside, a drain port from which the liquid is drained to the outside, a supply channel communicating with the channel unit, and a drainage channel branching off from the supply channel and communicating with the outside via the drain port. The recording apparatus may further comprise a plurality of actuators configured to apply pressure to the liquid in the pressure chamber. The recording apparatus may further comprise a meniscus vibrator configured to drive the actuators to vibrate meniscus produced in the nozzles without causing liquid droplets to be ejected therefrom when the liquid supplied from the supply port is being drained from the drain port after traveling through the supply channel and the drainage channel.

The inventor found that the withstanding pressure of the meniscus produced in the nozzles may be increased by vibrating the meniscus. According to the embodiment, when the liquid supplied from the supply port is being drained from the drain port, the withstanding pressure of the menisci produced in the nozzles is increased by vibrating the meniscus. Therefore, the amount of liquid drained per unit time can be increased, thereby allowing for higher air removal efficiency and reducing liquid consumption.

According to an embodiment herein, a recording apparatus may comprise a channel means comprising a pressure chamber for storing a liquid to be ejected, and nozzles for ejecting the liquid. The recording apparatus may further comprise a reservoir means connected to the channel means and comprising a supply port to which the liquid is supplied from an outside, a drain port from which the liquid is drained to the outside, a supply channel communicating with the channel means, and a drainage channel branching off from the supply channel and communicating with the outside via the drain port. The recording apparatus may further comprise a plurality of actuators for applying pressure to the liquid in the pressure chamber. The recording apparatus may further comprise a meniscus vibrating means for driving the actuators to vibrate meniscus produced in the nozzles without causing liquid droplets to be ejected therefrom when the liquid supplied from the supply port is being drained from the drain port after traveling through the supply channel and the drainage channel.

According to an embodiment herein, an inkjet printer may comprise a feed unit configured to feed a sheet, a discharge unit configured to discharge the sheet, and a conveying mechanism configured to convey the sheet from the feed unit towards the discharge unit. The inkjet printer may also further comprise an inkjet head comprising a channel unit comprising a pressure chamber configured to store a liquid to be ejected, and nozzles configured to eject the liquid; a reservoir unit connected to the channel unit and comprising a supply port to which the liquid is supplied from an outside, a drain port from which the liquid is drained to the outside, a supply channel communicating with the channel unit, and a drainage channel branching off from the supply channel and communicating with the outside via the drain port; a plurality of actuators configured to apply pressure to the liquid in the pressure chamber; and a meniscus vibrator configured to drive the actuators to vibrate meniscus produced in the nozzles without causing liquid droplets to be ejected therefrom when the liquid supplied from the supply port is being drained from the drain port after traveling through the supply channel and the drainage channel.

Other objects, features and advantages will be apparent to those skilled in the art from the following detailed description and accompanying drawings.

BRIEF DESCRIPTION OF THE DRAWINGS

Embodiments of a recording apparatus and an inkjet printer are described with reference to the accompanying drawings, which are given by way of example only, and are not intended to limit the present patent.

FIG. 4B is a top view of the plate 12, whereas FIG. 4C is a bottom view of the plate 12.

DESCRIPTION OF THE EMBODIMENTS

Various embodiments, and their features and advantages, may be understood by referring to FIGS. 1-11, like numerals being used for corresponding parts in the various drawings.

Figure 1:
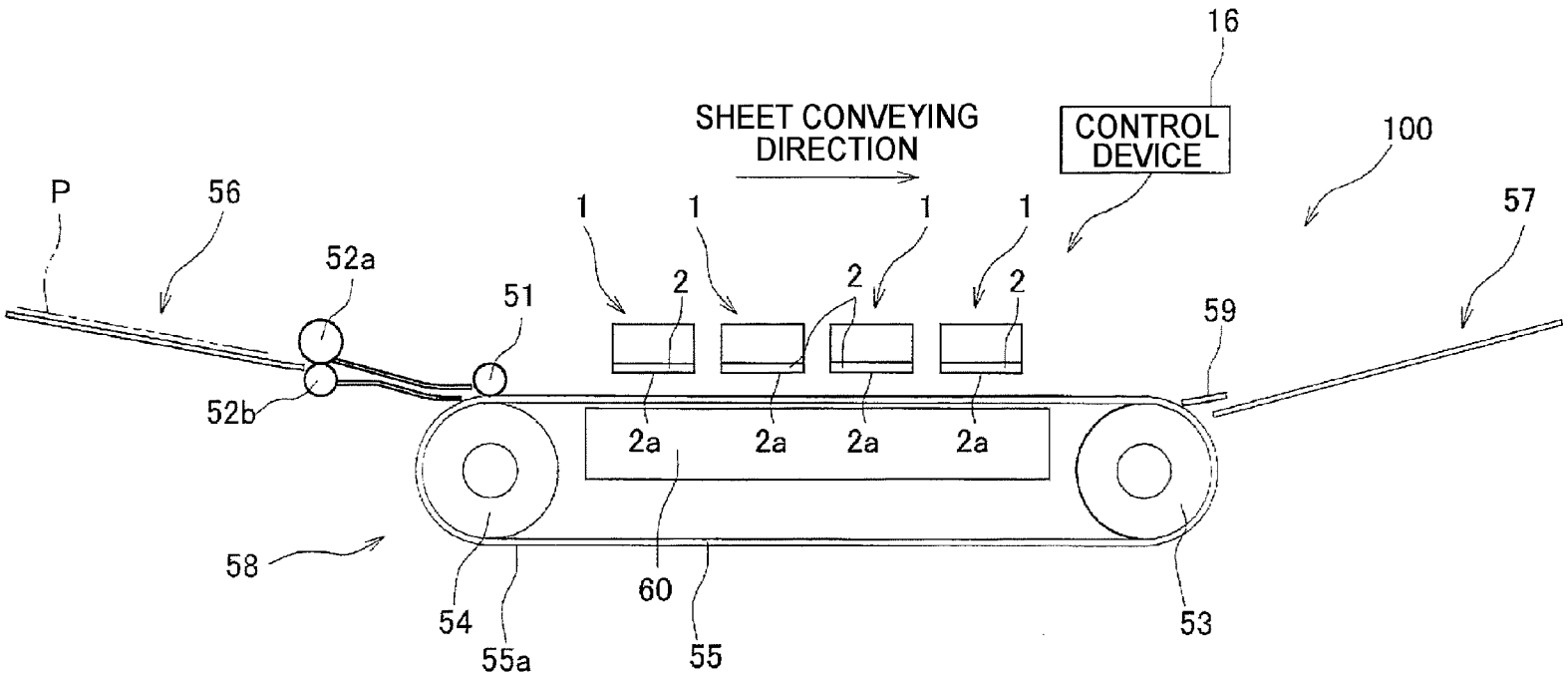
FIG. 1 is an side view of an inkjet printer according to an embodiment.

Referring to FIG. 1, an inkjet printer 100 may be a color inkjet printer including a plurality of, e.g., four, inkjet heads 1. The inkjet printer 100 may also include a feed unit 56 at the left side of the drawing and a discharge unit 57 at the right side of the drawing.

A sheet conveying path may be positioned inside the inkjet printer 100. A sheet P may be conveyed along the sheet conveying path from the feed unit 56 towards the discharge unit 57. A plurality of, e.g., two, feed rollers 52*a* and 52*b* that nip and convey the sheet P may be positioned downstream of the feed unit 56.

A conveying mechanism 58 may be positioned at a central part of the sheet conveying path. The conveying mechanism 58 may include a plurality of, e.g. two, belt rollers 53 and 54, an endless conveying belt 55 wound and bridged between the plurality of, e.g. two, belt rollers 53 and 54, and a platen 60 positioned within an area surrounded by the conveying belt 55. The platen 60 may oppose the inkjet heads 1 and may support the conveying belt 55 so as to prevent the conveying belt 55 from sagging. A nip roller 51 may be positioned opposing the belt roller 54. The sheet P fed from the feed unit 56 by the plurality of feed rollers 52*a* and 52*b* may be pressed against an outer surface 55*a* of the conveying belt 55 by the nip roller 51.

A conveying motor 19 (see FIG. 9) may rotate the belt roller 53 so as to drive the conveying belt 55. Therefore, the conveying belt 55 may convey the sheet P pressed against the outer surface 55*a* by the nip roller 51 towards the discharge unit 57. The sheet P may be adhesively held on the outer surface 55. The conveying belt 55 may be coated with a low-adhesion silicon resin layer.

A separator plate 59 may be positioned downstream of the conveying belt 55. The separator plate 59 may be configured to separate the sheet P adhered to the outer surface 55*a* of the conveying belt 55 from the outer surface 55*a* so as to guide the sheet P towards the discharge unit 57.

The plurality of, e.g., four, inkjet heads 1 may be securely arranged side by side each other in the sheet conveying direction. The plurality of inkjet heads may correspond to the plurality of, e.g., four, color inks, i.e., magenta, yellow, cyan, and black. The inkjet heads 1 each may include a head main body 2 at the bottom end thereof. The lower surface of each head main body 2 may function as an ink ejection surface 2*a* that opposes the outer surface 55*a* of the conveying belt 55. As the sheet P conveyed by the conveying belt 55 passes right below the plurality of, e.g., four, head main bodies 2 in sequence, the plurality of, e.g., four, color inks may be ejected from the respective ink ejection surfaces 2*a* towards the front surface, i.e., the printing surface, of the sheet P. Therefore, a desired color image may be formed on the printing surface of the sheet P.

Figure 2:
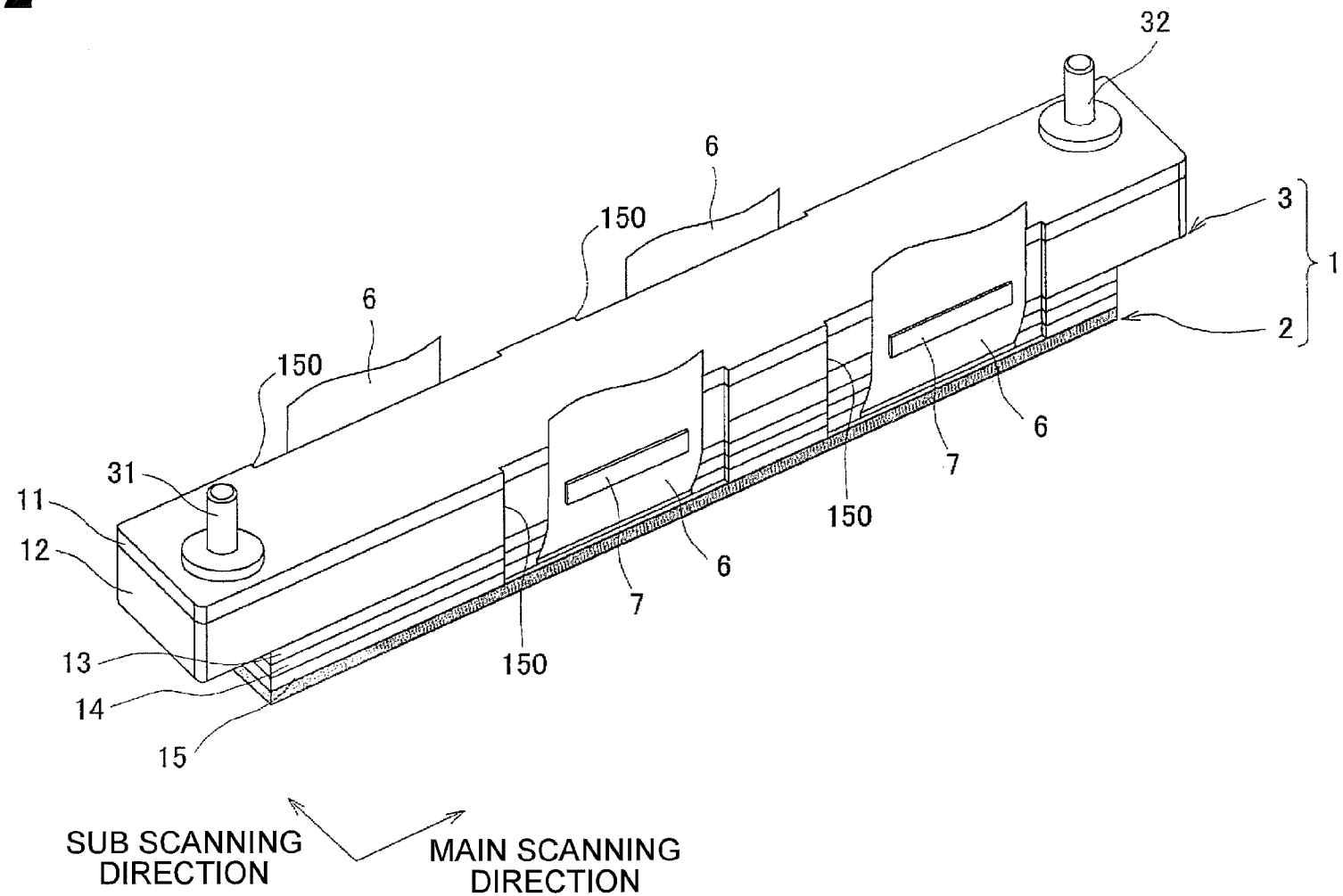
FIG. 2 is an external perspective view of one of inkjet heads.

Referring to FIG. 2, the inkjet head 1 may be rectangular in the main scanning direction and may include the head main body 2 and the reservoir unit 3, which temporarily stores ink, in that order from the bottom. A plurality of, e.g., four, flexible printed circuits (FPCs) 6 functioning as electrical feed members may be bonded on the upper surface of the head main body 2. The FPCs 6 may extend outward from a gap between the head main body 2 and the reservoir unit 3 and may be routed upward along recesses 150 formed on the side surfaces of the reservoir unit 3. One end of each of the FPCs 6 may be connected to a corresponding actuator unit 21, whereas another end thereof is connected to a control board (not shown). A driver integrated circuit (IC) 7 may be mounted on the FPC 6 at an intermediate position between the actuator unit 21 and the control board. The FPC 6 may be electrically connected to the control board and the driver IC 7. The FPC 6 may be configured to transmit a signal output from the control board to the driver IC 7 and supply a driving signal output from the driver IC 7 to the actuator unit 21.

Figure 3:
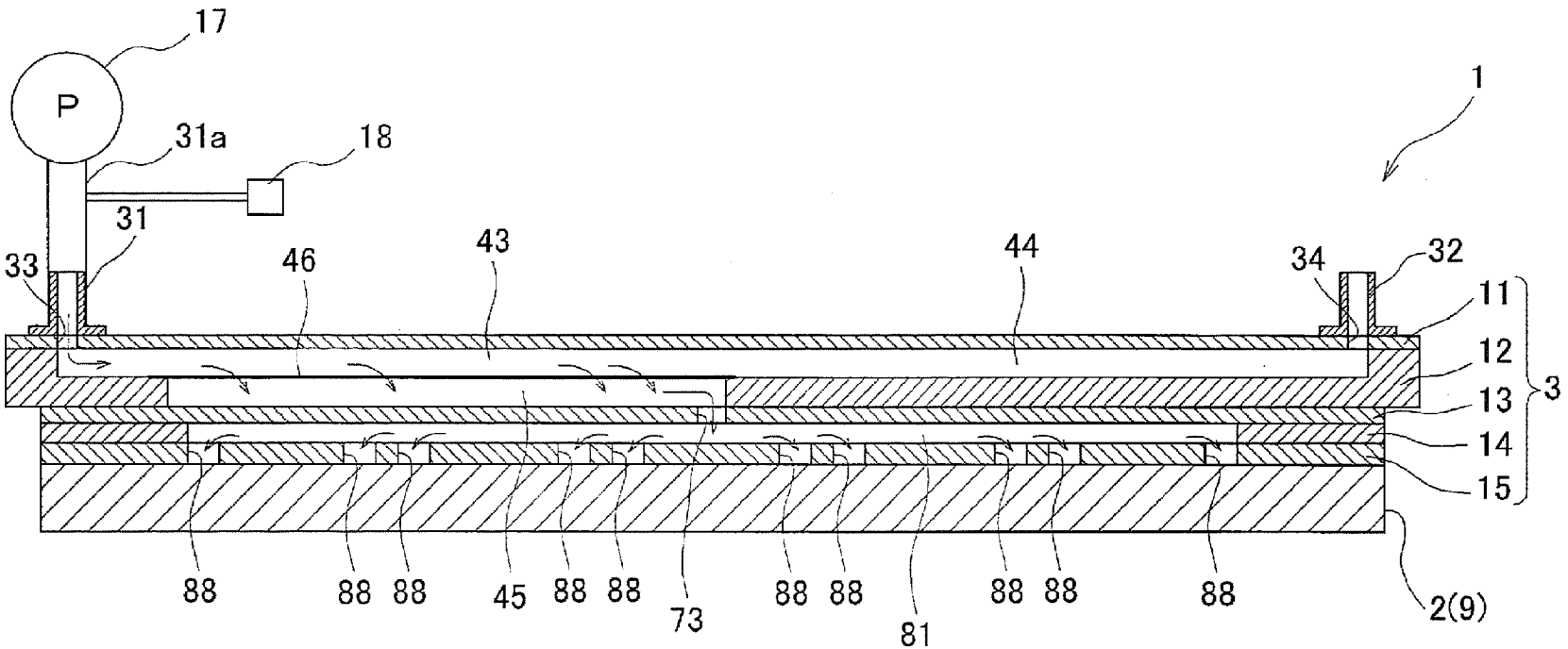
FIG. 3 is a longitudinal sectional view of the inkjet head.

The reservoir unit 3 may be configured to temporarily store the corresponding ink as well as supply the ink to a channel unit 9 connected to the reservoir unit 3. Referring to FIG. 3 and FIGS. 4A to 4F, the reservoir unit 3 may have a layer stack structure constituted by a plurality of, e.g., five, stacked plates 11 to 15 that are substantially rectangular in a plan view and elongate in the main scanning direction. These plurality of plates 11 to 15 may be plate members made of a metallic material such as stainless steel. For illustrative purposes, FIG. 3 shows the vertical direction at an enlarged scale, and also illustrates ink channels in the reservoir unit 3 that are actually not viewable in a sectional view taken along a single line.

Figure 4A:
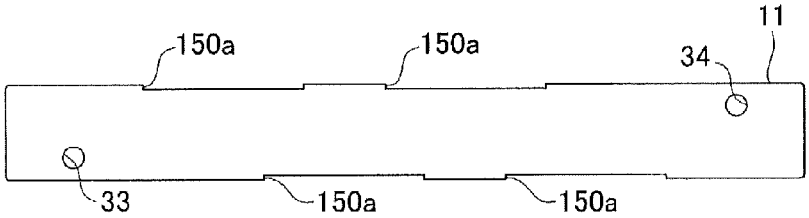
FIGS. 4A to 4F are plan views of plates that constitute a reservoir unit.

Referring to FIGS. 3 and 4A, the plate 11 may have through-holes 33 and 34 respectively at the opposite ends of the reservoir unit 3 in the longitudinal direction thereof. The through-hole 33 may be joined to a joint member 31. The through-hole 34 may be joined to a joint member 32. The upper opening of the through-hole 33 may function as a supply port to which the ink is supplied. The upper opening of the through-hole 34 may function as a drain port from which the ink is drained during a purging operation. The joint member 32 may be provided with an electromagnetic valve 20 (see FIG. 9) that opens and closes the joint member 32. The electromagnetic valve 20 may be controlled by a drainage-pump control unit 65 of a control device 16. The plate 11 may have a plurality of, e.g., four, cutouts 150*a* on opposite sides thereof in the widthwise direction. A plurality of, e.g., two, cutouts 150*a* may be arranged on each side in the lengthwise direction.

Figure 4B:
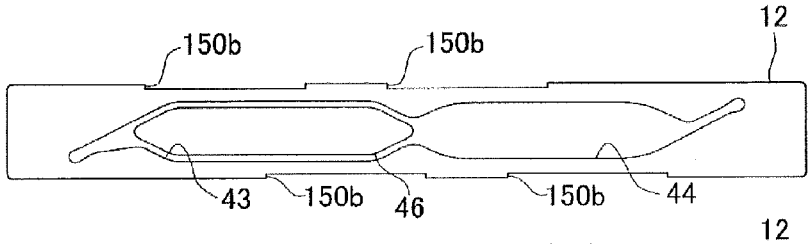

Referring to FIGS. 3 and 4B, the plate 12 may have an ink inflow channel 43 and an ink drainage channel 44 in substantially the upper half thereof in the thickness direction. The ink inflow channel 43 may extend from a position opposing the through-hole 33. The ink drainage channel 44 may extend to a position opposing the through-hole 34. The ink inflow channel 43 and the ink drainage channel 44 may be connected to each other at substantially a central portion of the plate 12 in the longitudinal direction. Accordingly, the ink inflow channel 43 may communicate with the supply port of the through-hole 33 at one end of the reservoir unit 3 in the longitudinal direction. The ink drainage channel 44 may branch off at the substantially central portion in the longitudinal direction so as to communicate with the drain port of the through-hole 34 at the other end of the reservoir unit 3. The ink inflow channel 43 and the ink drainage channel 44 may have substantially symmetrical shapes with respect to the center of the plate 12. The ink inflow channel 43 may extend narrowly from the position opposing the through-hole 33 towards the center of the plate 12. Further, the ink inflow channel 43 may become wider in the widthwise direction from an intermediate point thereof towards the center. Further, the ink inflow channel 43 may become narrow again at the center where the ink inflow channel 43 connects to the end of the ink drainage channel 44. The plate 11 may be stacked on the upper surface of the plate 12 so as to seal the openings of the ink inflow channel 43 and the ink drainage channel 44.

Figure 4C:
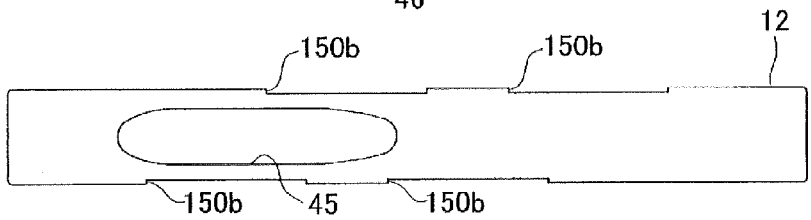

Referring to FIGS. 3 and 4C, the plate 12 may have a lower channel 45 in substantially the lower half thereof in the thickness direction. The lower channel 45 may be positioned opposing the wider section of the ink inflow channel 43 and may communicate with the ink inflow channel 43 in the thickness direction of the plate 12. A filter 46 may be positioned between the ink inflow channel 43 and the lower channel 45. The filter 46, the ink inflow channel 43 and the lower channel 45 may constitute a filter chamber. The filter chamber may extend in the longitudinal direction of the reservoir unit 3. The ink in the ink inflow channel 43 may flow into the lower channel 45 by passing through the filter 46. Accordingly, a supply channel to which the ink is supplied from the outside may include the filter 46, which is elongate in the longitudinal direction of the reservoir unit 3, and the filter chamber, which is divided into two chambers by the filter 46. The two divided chambers of the filter chamber may be respectively defined by the ink inflow channel 43 (i.e., an upstream liquid chamber) positioned on the upstream of the filter 46 and the lower channel 45 (i.e., a downstream liquid chamber) positioned on the downstream of the filter 46.

The plate 12 may have a plurality of, e.g., four, cutouts 150*b* on opposite sides thereof in the widthwise direction, namely, a plurality of, e.g., two, cutouts 150*b* on each side. The cutouts 150*b* may be respectively positioned in alignment with the cutouts 150*a* of the plate 11.

Figure 4D:
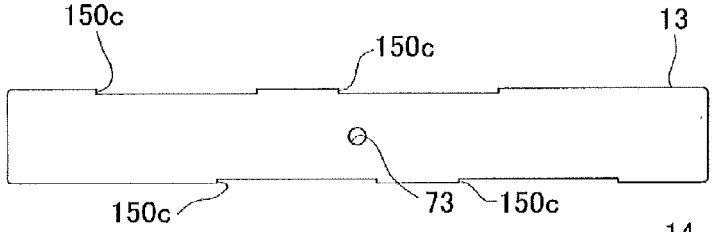

Referring to FIGS. 3 and 4D, the third plate 13 from the top may have a through-hole 73 in substantially a central portion thereof. The through-hole 73 may communicate with the right end of the lower channel 45 of the plate 12. The plate 13 may have a plurality of, e.g., four, cutouts 150*c* on opposite sides thereof in the widthwise direction, namely, a plurality of, e.g., two, cutouts 150*c* on each side. The cutouts 150*c* may be respectively positioned in alignment with the cutouts 150*b* of the plate 12.

Figure 4E:
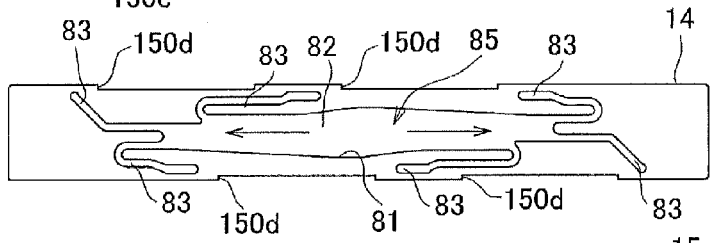

Referring to FIGS. 3 and 4E, the fourth plate 14 from the top may have a through-hole 81. The through-hole 81 may form a reservoir channel 85 that includes a main channel 82 and a plurality of, e.g., six, sub channels 83 communicating with the main channel 82. In a plan view, the reservoir channel 85 may be point-symmetrical with respect to the center of the plate 14. The main channel 82 may extend toward the opposite ends of the plate 14 in the longitudinal direction. The central portion of the main channel 82 may communicate with the through-hole 73 of the plate 13. Each of the sub channels 83 may be made narrower than the main channel 82. The plate 14 may have a plurality of, e.g., four, cutouts 150*d* on opposite sides thereof in the widthwise direction, namely, a plurality of, e.g., two, cutouts 150*d* on each side. The cutouts 150*d* may be respectively positioned in alignment with the cutouts 150*c* of the plate 13.

Figure 4F:
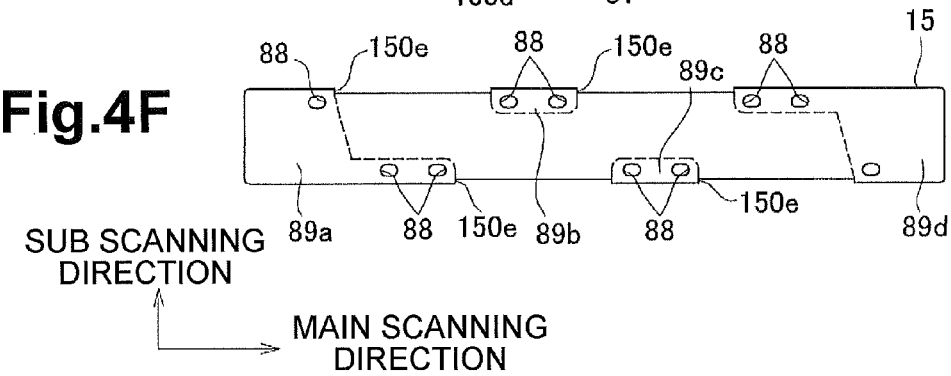

Referring to FIGS. 3 and 4F, the fifth plate 15 from the top may have ink supply holes 88 that are substantially elliptical in a plan view and formed at positions opposing the ends of the corresponding sub channels 83. The ink supply holes 88 may be surrounded by downward protruding portions 89*a*, 89*b*, 89*c*, and 89*d* (i.e., portions indicated by dashed lines in FIG. 4F) positioned on the lower surface of the plate 15. The projecting portions 89*a*, 89*b*, 89*c*, and 89*d* of the plate 15 may be fixed to the upper surface of the channel unit 9 with a plurality of, e.g., six, filter plates 95*a* and 95*b* (see FIG. 5) interposed therebetween. On the other hand, the remaining area of the plate 15 excluding the projecting portions 89*a*, 89*b*, 89*c*, and 89*d* may be spaced apart from the channel unit 9 by a certain gap. The actuator units 21 on the upper surface of the channel unit 9 may be positioned within this gap formed between the remaining area of the plate 15 and the channel unit 9. Referring back to FIG. 2, the FPCs 6 connected to the actuator units 21 may extend outward from this gap. The plate 15 may have a plurality of, e.g., four, cutouts 150*e* on opposite sides thereof in the widthwise direction, namely, a plurality of, e.g., two, cutouts 150*e* on each side. The cutouts 150*e* may be respectively positioned in alignment with the cutouts 150*d* of the plate 14.

The plurality of, e.g., five, plates 11 to 15 may be fitted position and fixed to each other with an adhesive so as to constitute the reservoir unit 3. The cutouts 150*a* to 150*e* may be aligned with each other so as to form the recesses 150 extending from bottom to top of the reservoir unit 3.

Referring to FIG. 3, an ink tank (not shown) and the joint member 31 may be connected to each other through an ink supply tube 31*a*. The ink supply tube 31*a* may be provided with a drainage pump 17 and a pressure sensor 18. Under the control of the drainage-pump control unit 65 of the control device 16 (see FIG. 9), the drainage pump 17 may cause the ink in the ink tank to be enforcedly supplied to the reservoir unit 3 during a purging operation. The pressure sensor 18 may be configured to detect the pressure of the ink in the ink supply tube 31*a* at a position near the joint member 31.

The flow of ink in the reservoir unit 3 when ink is supplied thereto will now be described.

Normally, the channels may be entirely filled with ink. When the actuator units 21 are driven, ink droplets may be ejected onto the sheet P. In this case, the ink to be consumed may be supplied from the ink tank to the joint member 31 via the ink supply tube 31*a*. The ink flowing into the supply port from the joint member 31 may travel through the through-hole 33 of the plate 11 so as to flow into the ink inflow channel 43 of the plate 12. The ink may be then filtered by the filter 46 that separates the ink inflow channel 43 and the lower channel 45, and may subsequently flow from the lower channel 45 to the reservoir channel 85 of the plate 14 via the through-hole 73. In the reservoir channel 85 (i.e., the main channel 82), the ink may flow toward the opposite ends thereof in the longitudinal direction. At the opposite ends of the main channel 82, the ink may be distributed to the sub channels 83 so as to flow towards the corresponding ink supply holes 88 of the plate 15. Since the ink supply holes 88 communicate with ink supply ports 101 formed in the channel unit 9 to be described later, the ink may be subsequently supplied to the channel unit 9.

Figure 9:
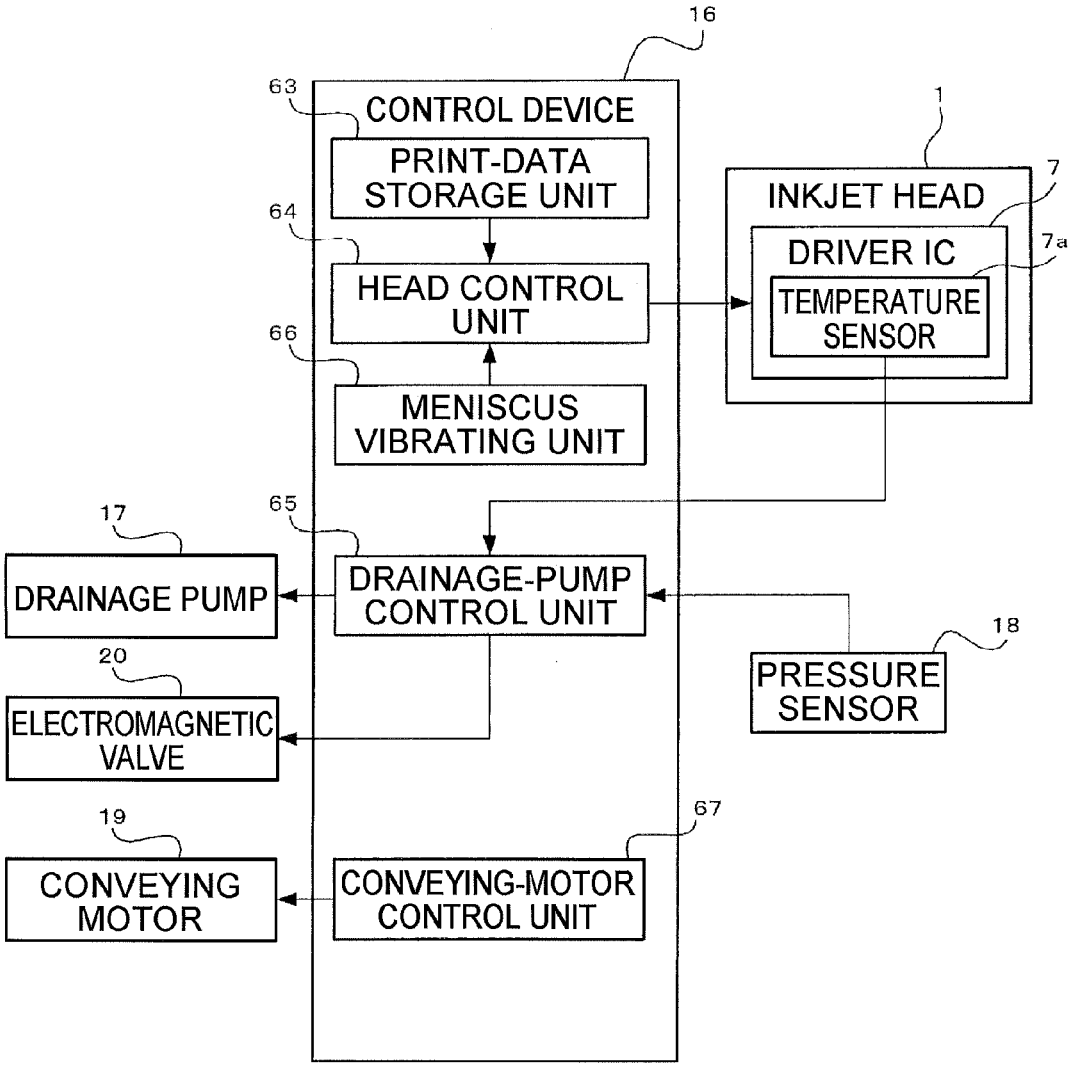
FIG. 9 is a functional block diagram of a control device.

When ink is to be initially introduced or when a drainage operation for draining bubbles and foreign matter from the ink channels is to be performed, the joint member 32 may be opened by the electromagnetic valve 20 (see FIG. 9). Then, the drainage pump 17 may cause ink to be enforcedly supplied to the joint member 31. Thus, the ink supplied to the supply port from the joint member 31 may flow into the ink drainage channel 44 via the ink inflow channel 43 and may be subsequently drained from the joint member 32 via the drain port. At the same time, bubbles and foreign matter existing in the channels may be drained from the channels together with the ink. Subsequently, the joint member 32 may be closed, whereby the channels may become entirely filled with fresh ink.

Figure 5:
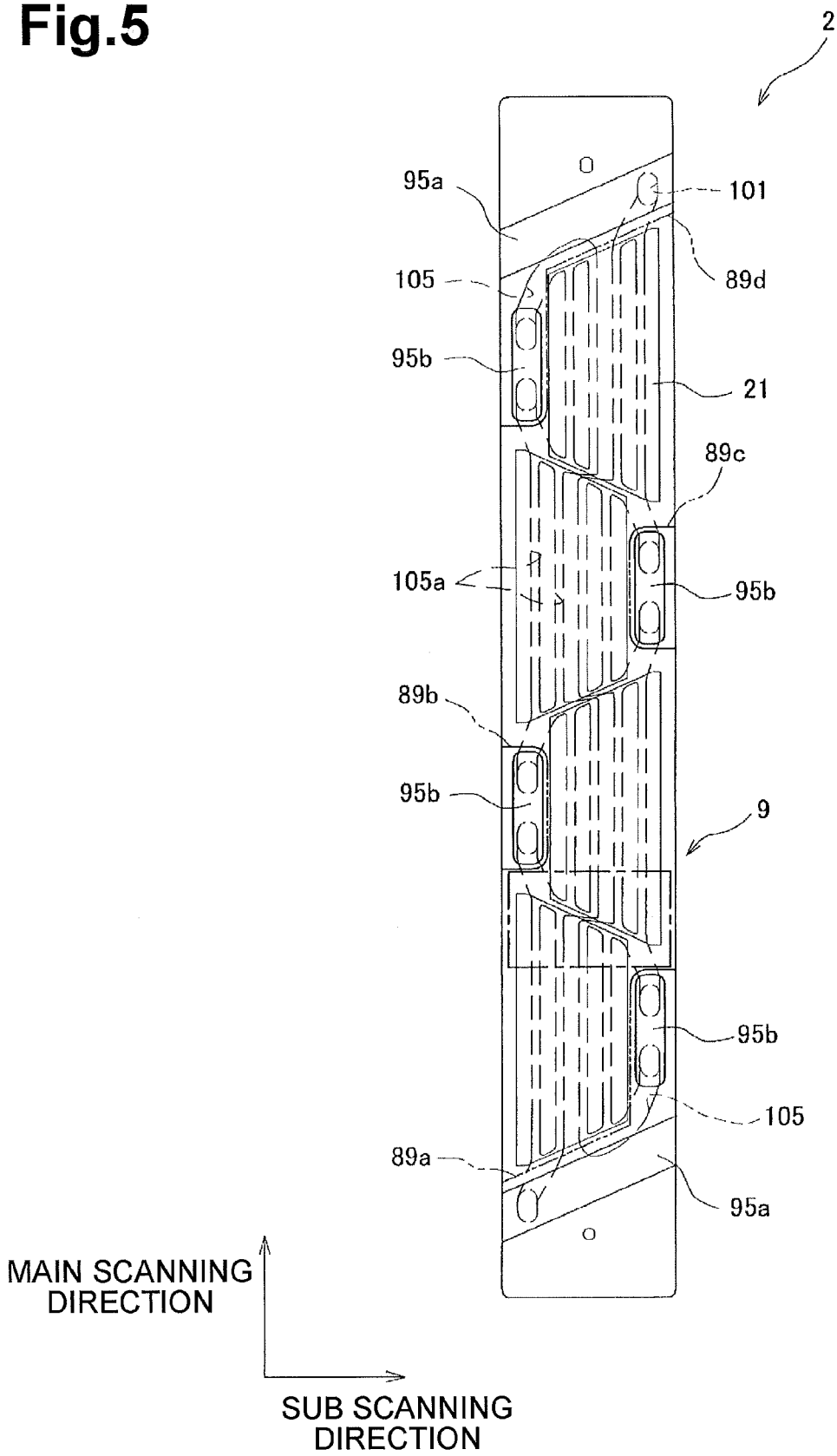
FIG. 5 is a plan view of a head main body.

Referring to FIG. 5, the head main body 2 may include the channel unit 9 and a plurality of, e.g., four, actuator units 21 positioned on the upper surface of the channel unit 9. The actuator units 21 may apply ejection energy selectively to the ink in the pressure chambers 110 formed in the channel unit 9.

Figure 6:
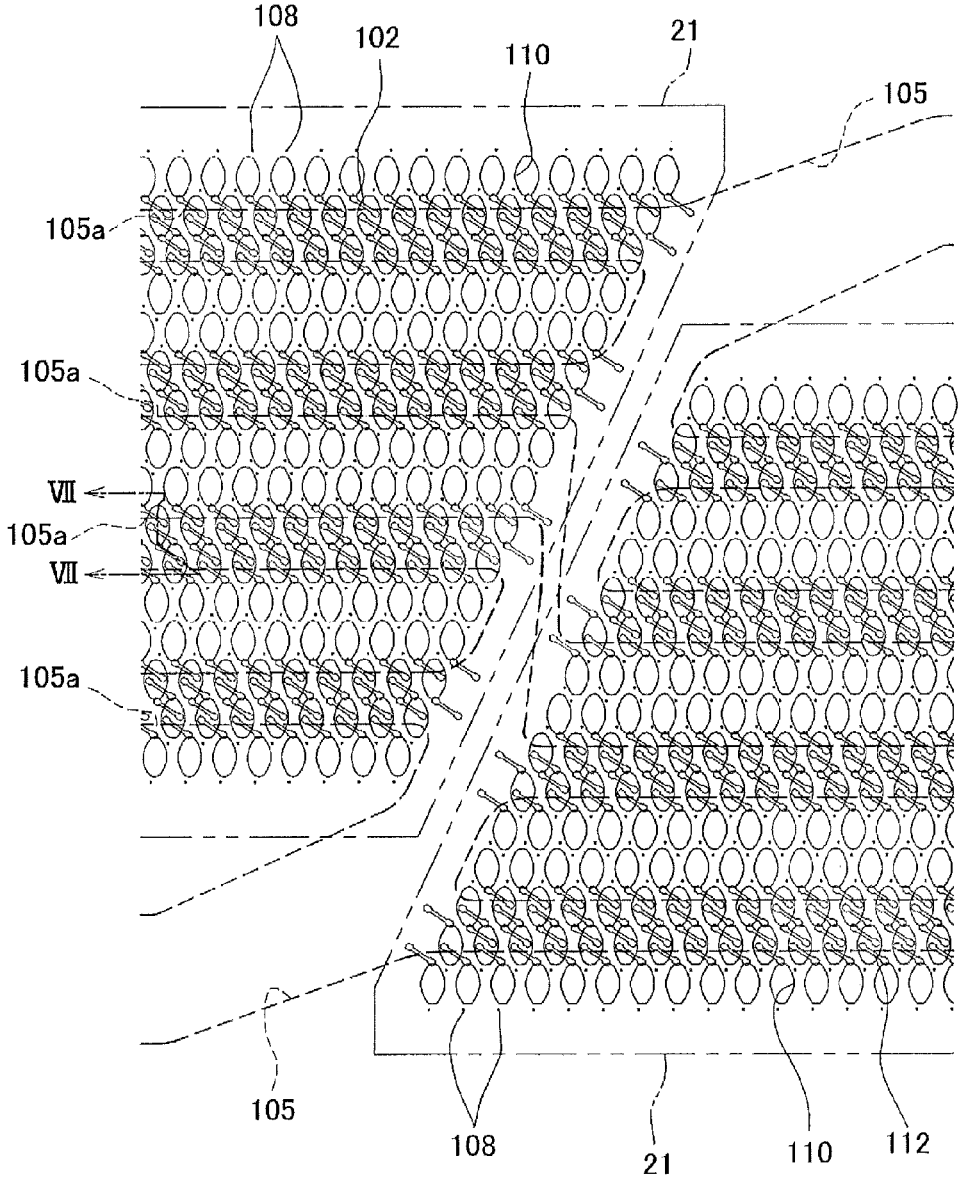
FIG. 6 is a partial enlarged view of an area shown in FIG. 5.
Figure 7:
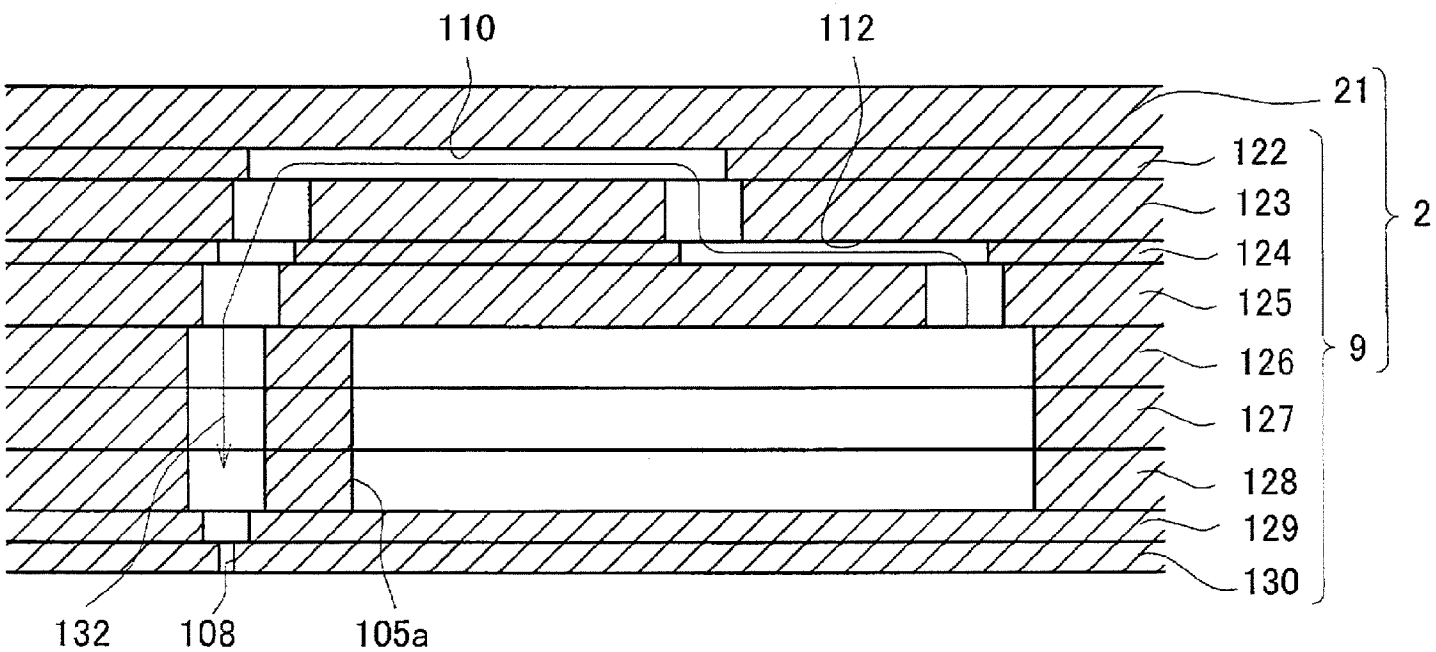
FIG. 7 is a cross-sectional view taken along line VII-VII in FIG. 6.

The channel unit 9 may substantially have a rectangular parallelepiped shape with substantially the same width and the same length in the main scanning direction as the reservoir unit 3. Referring to FIGS. 6 and 7, the lower surface of the channel unit 9 may function as the ink ejection surface 2*a* having a plurality of nozzles 108 arranged in a matrix. Similar to the nozzles 108, the pressure chambers 110 may be also arranged in a matrix in a surface where the channel unit 9 and the actuator units 21 are fixed to each other.

Referring to FIG. 6, a plurality of, e.g., sixteen, pressure chamber arrays may be arranged parallel to each other in the widthwise direction of the channel unit 9. Each array including a plurality of pressure chambers 110 may be arranged at equal intervals in the longitudinal direction of the channel unit 9. The number of pressure chambers 110 included in each pressure chamber array may decrease gradually from the longer side towards the shorter side of the trapezoidal shape of the corresponding actuator unit 21. The nozzles 108 may be arranged in the similar manner. For illustrative purposes, pressure chambers 110, apertures 112, and nozzles 108 are shown with solid lines in FIG. 6.

Referring to FIG. 7, the channel unit 9 may include a plurality of, e.g., nine, stacked metallic plates. The plurality of staked metallic plates may be, from top to bottom, a cavity plate 122, a base plate 123, an aperture plate 124, a supply plate 125, manifold plates 126, 127, and 128, a cover plate 129, and a nozzle plate 130. The plates 122 to 130 may be rectangular in a plan view and may be elongate in the main scanning direction (see FIG. 2).

The cavity plate 122 may have through-holes opposing the corresponding ink supply ports 101 (see FIG. 5) as well as a plurality of substantially rhombic through-holes opposing the corresponding pressure chambers 110. The base plate 123 may have communication holes for between the pressure chambers 110 and the apertures 112, communication holes for between the pressure chambers 110 and the nozzles 108, and communication holes for between the ink supply ports 101 and manifold channels 105. The aperture plate 124 may have through-holes that form the apertures 112, communication holes for between the pressure chambers 110 and the nozzles 108, and communication holes for between the ink supply ports 101 and the manifold channels 105. The supply plate 125 may have communication holes for between the apertures 112 and sub manifold channels 105*a*, communication holes for between the pressure chambers 110 and the nozzles 108, and communication holes for between the ink supply ports 101 and the manifold channels 105. The manifold plates 126, 127, and 128 each may have communication holes for between the pressure chambers 110 and the nozzles 108 and through-holes that are joined to each other at the time of the stacking process so as to form the manifold channels 105 and the sub manifold channels 105*a*. The cover plate 129 has communication holes for between the pressure chambers 110 and the nozzles 108. The nozzle plate 130 has holes that form the nozzles 108 corresponding to the respective pressure chambers 110.

The plurality of, e.g., nine, plates 122 to 130 may be securely stacked one on top of the other while being positioned with respect to each other so that individual ink channels 132 may be formed in the channel unit 9, one of the individual ink channels 132 being shown in FIG. 7. The individual ink channels 132 may extend from an outlet of the sub manifold channel 105*a* to the nozzles 108 via the pressure chamber 110.

Referring back to FIG. 5, the upper surface of the channel unit 9 may have a plurality of filter plates 95*a* and 95*b* positioned thereon, which cover the ink supply ports 101. There may be a plurality of, e.g., six, filter plates 95*a* and 95*b* provided. The filter plates 95*a* and 95*b* may be positioned in areas that oppose the projecting portions 89*a* to 89*d* positioned on the plate 15 of the reservoir unit 3. The reservoir unit 3 may be joined to the channel unit 9 with the filter plates 95*a* and 95*b* interposed therebetween. The projecting portions 89*a* to 89*d* positioned on the plate 15 of the reservoir unit 3, the filter plates 95*a* and 95*b*, and the areas surrounding the ink supply ports 101 may be bonded together with an adhesive. Accordingly, the ink supply holes 88 in the projecting portions 89*a* to 89*d* may communicate with the corresponding ink supply ports 101.

The plurality of, e.g., four, actuator units 21 each have a trapezoidal shape in a plan view. The plurality of actuator unit 21 may be arranged in a zigzag pattern without overlapping the ink supply ports 101 and the filter plates 95*a* and 95*b* on the upper surface of the channel unit 9. The ink ejection surface 2*a* may be positioned on the lower surface of the channel unit 9 at a position corresponding to bonded regions of the actuator units 21. In other words, the ink ejection surface 2*a* and the surface in which the pressure chambers 110 are arranged may constitute a pair of opposite surfaces of the channel unit 9, and the individual ink channels 132 may be formed between the opposite surfaces. The opposite parallel sides of each actuator unit 21 having the trapezoidal shape may extend along the longitudinal direction of the channel unit 9. The oblique sides of neighboring actuator units 21 may overlap each other as viewed in the widthwise direction (i.e., sub scanning direction) of the channel unit 9.

As mentioned above, the reservoir unit 3 may be fixed to the channel unit 9 with the projecting portions 89*a* to 89*d* therebetween, such that the reservoir unit 3 and the channel unit 9 are spaced apart from each other by a gap having the height of these projecting portions 89*a* to 89*d*. The actuator units 21 may be positioned within the gap formed between the reservoir unit 3 and the channel unit 9. Although the FPCs 6 may be fixed on the actuator units 21, these FPCs 6 may be not in contact with the lower surface of the reservoir unit 3.

Figure 8A:
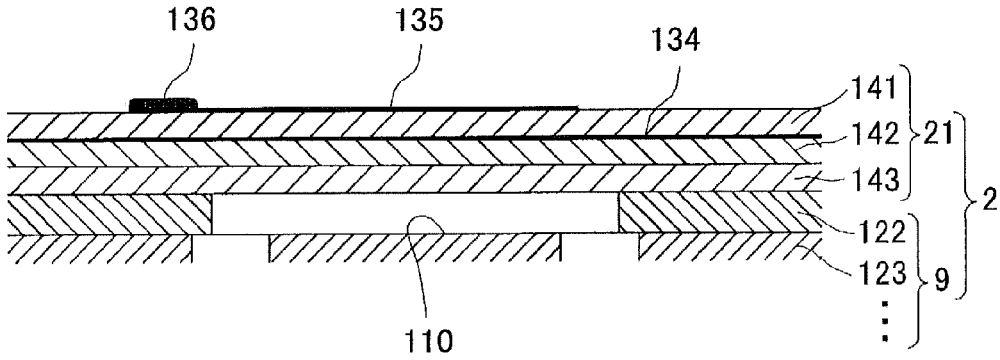
FIGS. 8A and 8B are enlarged views of a piezoelectric actuator and its surrounding area.

Referring to FIG. 8A, the actuator units 21 may be each configured of a plurality of, e.g., three, piezoelectric layers 141, 142, and 143. Each piezoelectric layers 141, 142, and 143 may have a thickness of about 15 μm and composed of a lead zirconium titanate (PZT) based ceramic material, which is ferroelectric. The piezoelectric layers 141 to 143 may be positioned over multiple pressure chambers 110 formed in correspondence to a single ink ejection surface 2*a*.

The uppermost piezoelectric layer 141 may have disposed thereon individual electrodes 135 at positions corresponding to the pressure chambers 110. The uppermost piezoelectric layer 141 and the piezoelectric layer 142 therebelow may have a common electrode 134 interposed therebetween. The common electrode may have a thickness of about 2 μm and may be extended entirely over the piezoelectric layers 141 and 142. The individual electrodes 135 and the common electrode 134 may be made of, for example, an Ag—Pd based metallic material. The piezoelectric layers 142 and 143 may have no electrodes positioned therebetween.

Figure 8B:
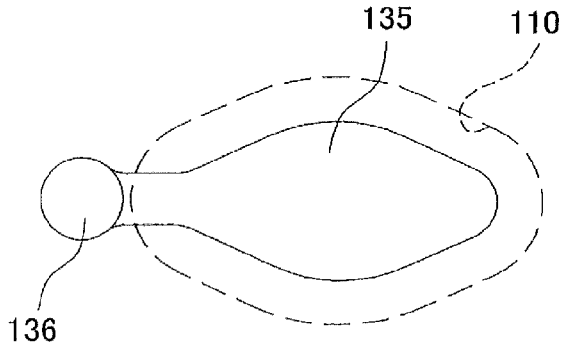

Referring to FIG. 8B, each of the individual electrodes 135 may have a thickness of about 1 μm and may have a substantially rhombic shape in a plan view, which is similar to that of the pressure chamber 110. One of the acute sections of the substantially rhombic individual electrode 135 may be extended, and the tip thereof may be provided with a circular land 136 having a diameter of about 160 μm. The circular land 136 may be electrically connected to the individual electrode 135.

The common electrode 134 may be connected to ground. Thus, the common electrode 134 may be maintained at an equal ground potential over an area corresponding to all the pressure chambers 110. On the other hand, the electric potential of each individual electrode 135 may be selectively controlled by the control board (not shown) via the corresponding FPC 6.

A method for driving the actuator units 21 will be described below. Each actuator unit 21 may be a so-called unimorph piezoelectric actuator. The piezoelectric layer 141 may be polarized in the thickness direction thereof. Each individual electrode 135 may be set to an electric potential different from that of the common electrode 134. When an electric field is applied to the piezoelectric layer 141 in the polarized direction thereof, the electric-field receiving section in the piezoelectric layer 141 may act as an active section that warps due to a piezoelectric effect. In other words, the piezoelectric layer 141 may expand or contract in the thickness direction thereof while it tries to contract or expand in the planar direction thereof due to a transverse piezoelectric effect. On the other hand, the plurality of, e.g., two, remaining piezoelectric layers 142 and 143 may be inactive layers not having areas interposed between the individual electrode 135 and the common electrode 134, and may be thus incapable of self-deforming.

When an electric field is applied to the piezoelectric layer 141 in the same direction as the polarized direction thereof, the piezoelectric layer 141 may contract in the planar direction thereof, thus resulting in a difference in warpage between the piezoelectric layer 141 and the piezoelectric layers 142 and 143 positioned therebelow. This difference in warpage may cause all of the piezoelectric layers 141 to 143 to deform in a convex shape towards the corresponding pressure chamber 110 (i.e., unimorph deformation). As a result, the capacity of the pressure chamber 110 may decrease, thus causing ink to be ejected from the corresponding nozzle 108. Subsequently, when the individual electrode 135 is set to the same electric potential as the common electrode 134, the previously deformed piezoelectric layers 141 to 143 may recover their original shape. In consequence, ink may be introduced into the pressure chamber 110 from the corresponding manifold channel 105, thereby refilling the pressure chamber 110 with the ink.

Referring to FIG. 9, the control device 16 may include a print-data storage unit 63, a head control unit 64, a conveying-motor control unit 67, the drainage-pump control unit 65, and a meniscus vibrating unit 66.

The print-data storage unit 63 may be configured to store print data transferred thereto from a host computer (not shown). The print data may contain image data of an image to be formed on the sheet P. The image data may be used as drive data by the head control unit 64 for driving the actuator units 21. The image data may also be an aggregate of dot data items that indicate the size of liquid droplets (i.e., large droplets, medium droplets, or small droplets) to be ejected from the nozzles 108 that correspond to dots constituting the image.

The head control unit 64 may be configured to output a control signal to the driver ICs 7 to drive the actuator units 21. The head control unit 64 may also cause ink droplets to be ejected from the nozzles 108 so that the image based on the print data stored in the print-data storage unit 63 is formed on the sheet P conveyed by the conveying mechanism 58.

The conveying-motor control unit 67 may be configured to control the driving speed of the conveying motor 19 so that the conveying belt 55 is driven in a predetermined speed pattern (including an acceleration pattern, a constant-speed pattern, and a deceleration pattern).

Figure 10:
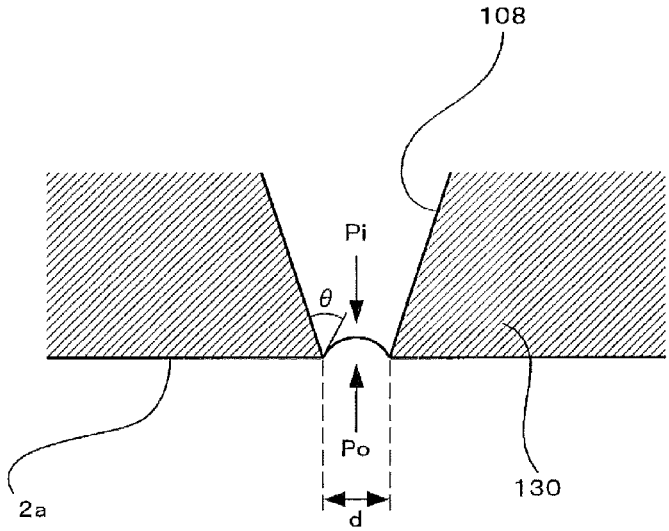
FIG. 10 is a cross-sectional view of a nozzle plate and shows a state of a meniscus produced in a nozzle.

Referring to FIG. 10, when there is an instruction from the user or when a predetermined condition is satisfied in the inkjet printer 100 (e.g., when the power is turned on, when a predetermined time has elapsed after the power is turned on, or when ink is initially introduced), the drainage-pump control unit 65 may perform a purging operation (including a drainage operation) for enforcedly draining the ink in the channel unit 9 of each inkjet head 1 to the outside. Specifically, based on a detection result of the pressure sensor 18 and a detection result of a temperature sensor 7*a* included in each driver IC 7, the drainage-pump control unit 65 may control the driving of the drainage pump 17 and the opening/closing of the joint member 32.

When the drainage operation commences, the drainage-pump control unit 65 may control the electromagnetic valve 20 so as to open the joint member 32. Then, the drainage-pump control unit 65 may drive the drainage pump 17 so as to enforcedly supply the ink in the ink tank to the reservoir unit 3 through the joint member 31. Thus, the ink supplied to the joint member 31 may flow into the ink drainage channel 44 through the ink inflow channel 43 (i.e., the upstream liquid chamber of the filter chamber) and may be subsequently drained from the joint member 32. Consequently, bubbles and foreign matter existing in the channel extending from the ink inflow channel 43 to the ink drainage channel 44 may be drained to the outside together with the ink. In this case, the drainage-pump control unit 65 may drive the drainage pump 17 so that the pressure of ink supplied to the reservoir unit 3 is lower than a meniscus withstanding pressure P, which is a pressure that causes the menisci produced in the nozzles 108 to break. After a predetermined amount of ink is drained from the joint member 32, the drainage-pump control unit 65 may close the joint member 32 by using the electromagnetic valve 20, thereby completing the drainage operation. The amount of drained ink may be calculated from the driving period of the drainage pump 17.

Referring to FIG. 10, the meniscus withstanding pressure P is expressed as follows:

$$P=4\sigma\cdot\cos\theta/d$$

where σ denotes the surface tension of the ink, θ denotes the contact angle of the ink in the nozzle 108, and d denotes the diameter of the nozzle 108. The surface tension σ of the ink increases as the viscosity of the ink becomes higher. The viscosity of the ink becomes lower as the temperature of the ink increases. Therefore, the meniscus withstanding pressure P decreases as the temperature of the ink increases. The drainage-pump control unit 65 may calculate the temperature of the ink in the channel unit 9 on the basis of the detection result of the temperature sensors 7*a* included in the driver ICs 7. Then, the drainage-pump control unit 65 may calculate the meniscus withstanding pressure P on the basis of the temperature of the ink. Moreover, the drainage-pump control unit 65 may control the driving of the drainage pump 17 so that the pressure detected by the pressure sensor 18 (i.e., the pressure of ink supplied to the reservoir unit 3) is equal to a predetermined pressure that is lower than the meniscus withstanding pressure P. In this manner, the drainage-pump control unit 65 may drive the drainage pump 17 so that the flow rate of ink drained per unit time is reduced as the temperature of the ink increases. Accordingly, the flow rate of ink drained per unit time may be increased to the maximum extent without causing the menisci to break, thereby allowing for an efficient ink drainage operation.

Figure 11:
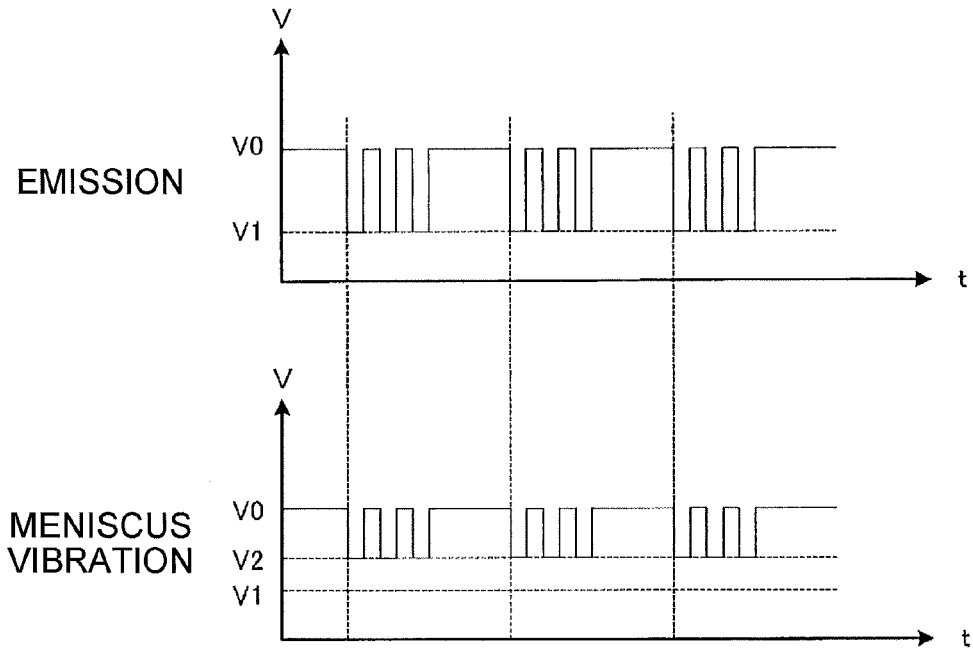
FIG. 11 is a driving waveform diagram for explaining the function of a meniscus vibrating unit.

Referring to FIG. 11, when the drainage-pump control unit 65 is performing the drainage operation, the meniscus vibrating unit 66 may drive the actuator units 21 via the head control unit 64 so as to vibrate the menisci produced in all the nozzles 108 without causing ink droplets to be ejected therefrom.

More specifically, when ink droplets are to be ejected from the nozzles 108, the head control unit 64 may apply an ejection drive signal, containing electric potential V1 pulses for ejecting ink droplets, to the individual electrodes 135. On the other hand, when the drainage-pump control unit 65 starts the drainage operation, the meniscus vibrating unit 66 may apply a non-emission drive signal, containing electric potential V2 pulses for not ejecting ink droplets and having the same waveform as the emission drive signal, to all the individual electrodes 135 before the electromagnetic valve 20 opens the joint member 32. In consequence, the menisci produced in the nozzles 108 may vibrate. Although the emission drive signal and the non-emission drive signal have the same waveform in this embodiment, the non-emission drive signal may alternatively have a freely chosen waveform that causes the menisci to vibrate at a predetermined cycle. For example, the non-emission drive signal may have a waveform with successive pulses that are independent of the ink emission cycle. As a further alternative, the non-emission drive signal may have a waveform having the same voltage as the emission drive signal and formed of pulses having a pulse width that is narrowed to a degree that ink droplets are not ejected.

When the drainage-pump control unit 65 completes the drainage operation, the meniscus vibrating unit 66 may stop applying the non-emission drive signal to the individual electrodes 135 after the electromagnetic valve 20 closes the joint member 32. Accordingly, the menisci may be reliably prevented from breaking while the ink is being drained. If there is a pressure fluctuation remaining within the ink channels after the joint member 32 is closed, the meniscus vibrating unit 66 may vibrate the menisci until a lapse of a predetermined time after the joint member 32 is closed.

The inventor found that vibration of the menisci produced in the nozzles 108 may increase the meniscus withstanding pressure P to a value higher than that when the menisci were not vibrating. Therefore, when the menisci are vibrating, even if the pressure of ink supplied to the reservoir unit 3 exceeds the meniscus withstanding pressure P corresponding to when the menisci are not vibrating, the menisci may still be prevented from breaking.

In other words, the meniscus vibration during the drainage operation may increase the meniscus withstanding pressure P. Thus, during the ink drainage operation performed using the drainage pump 17, the menisci may be prevented from breaking. In addition, with the increase in the meniscus withstanding pressure P, the drainage-pump control unit 65 may drive the drainage pump 17 with a predetermined pressure higher than that when the menisci are not vibrating. In this case, the driving pressure of the drainage pump 17 may be set to a predetermined pressure that is lower than the meniscus withstanding pressure P when the menisci are vibrating. This predetermined pressure may be higher than the driving pressure used when the menisci are not vibrating. Consequently, since the flow rate of ink drained per unit time is increased, the ink and bubbles existing in the ink channels may be drained more efficiently. If the temperature of the ink increases, the drainage-pump control unit 65 may drive the drainage pump 17 so as to reduce the flow rate of ink drained per unit time.

After the above-described drainage operation is completed, a printing operation for printing an image on the sheet P on the basis of print data may be resumed under the control of the head control unit 64.

On the other hand, if it is necessary to drain thickened ink from the channel unit 9 or if there is a nozzle 108 with an emission failure that needs to be repaired, a purging operation may be performed following the drainage operation. During the purging operation, the electromagnetic valve 20 may be closed. In addition, the driving of the actuator units 21 may be stopped. The drainage-pump control unit 65 may enforcedly supply ink to all the nozzles 108 so that a predetermined amount of ink is ejected from each of the nozzles 108. During this time, the thickened ink and foreign matter in the channel unit 9 may be drained. The drained ink may be received by a waste tray (not shown) and may be temporarily stored in a waste tank. Since there are ink droplets remaining on the ink ejection surface 2*a* after the enforced ink drainage operation, the ink ejection surface 2*a* may be cleaned by wiping it with a wiper. In consequence, the menisci produced in the nozzles 108 may be corrected and the ejection performance of the nozzles 108 may be recovered. This may complete the purging operation. In the drainage operation and the purging operation, the drainage-pump control unit 65 may control the drainage pump 17 so as to drive it continuously. In this case, the drainage-pump control unit 65 may use the same amount of ink supplied per unit time for the drainage operation and the purging operation or may vary the amount between the two operations depending on the circumstances.

If a subsequent printing process is necessary, an image printing operation may be resumed under the control of the head control unit 64. If a printing process is not necessary, the ink ejection surface 2*a* may be covered with a cap (not shown) so as to proceed to a shut-off operation of the apparatus.

According to the embodiment described above, when the drainage-pump control unit 65 is performing the drainage operation to drain the ink supplied from the joint member 31 to the outside from the joint member 32, the meniscus vibrating unit 66 may vibrate the menisci in the nozzles 108 to increase the meniscus withstanding pressure P. Thus, the drainage-pump control unit 65 may increase the amount of ink drained per unit time, and bubbles and foreign matter existing in the ink channels may be drained with higher efficiency. Accordingly, the number of ink drainage operations may be reduced and the drainage time may be shortened, thereby reducing ink consumption.

Furthermore, when the drain port of the through-hole 34 is opened by the joint member 32, the drainage pump 17 may cause ink to be enforcedly supplied from the supply port of the through-hole 33 opposing the joint member 31 so as to drain the ink from the drain port. Accordingly, the drainage operation may be performed with a simple configuration.

In addition, since the drainage-pump control unit 65 controls the driving of the drainage pump 17 during the drainage operation so that the pressure detected by the pressure sensor 18 is lower than the meniscus withstanding pressure P, the menisci may be reliably prevented from breaking while the ink may be drained efficiently.

Moreover, since the drainage-pump control unit 65 controls the driving of the drainage pump 17 so that the flow rate of ink drained per unit time is reduced as the temperature of the ink increases, the menisci may be reliably prevented from breaking while the ink may be drained efficiently.

Furthermore, since the supply channel to which the ink is supplied from the outside is divided into the ink inflow channel 43 and the lower channel 45 by the filter 46, and the ink drainage channel 44 may be connected to the ink inflow channel 43, bubbles remaining in the filter chamber may be efficiently drained.

In this case, since one end of the ink inflow channel 43 in the lengthwise direction of the reservoir unit 3 communicates with the supply port of the through-hole 33 and the other end communicates with the ink drainage channel 44, bubbles remaining on the filter 46 may be efficiently drained.

Although an embodiment is described above, various modifications are permissible within the scope of the claims. For example, although the above embodiment may be configured such that, when the drain port of the through-hole 34 is opened by the joint member 32, the drainage pump 17 causes ink to be enforcedly supplied from the supply port of the through-hole 33 opposing the joint member 31 so as to drain the ink from the drain port. However, an alternative configuration is also permissible in which, when the drain port of the through-hole 34 is opened by the joint member 32, the drainage pump 17 may cause ink to be enforcedly drawn into the drain port of the through-hole 34 by suction so as to drain the ink from the drain port.

In this alternative configuration, the meniscus vibrating unit 66 may drive the actuator units 21 at least during the driving of the drainage pump 17 so as to vibrate the menisci. In this case, the meniscus vibrating unit 66 may start to vibrate the menisci before the driving of the drainage pump 17. Moreover, the meniscus vibrating unit 66 may continue to vibrate the menisci even after the drainage pump 17 is stopped.

Although the above embodiment may be configured such that the drainage-pump control unit 65 controls the driving of the drainage pump 17 so that the flow rate of ink drained per unit time is reduced as the temperature of the ink increases, the drainage-pump control unit 65 may alternatively be configured not to change the flow rate of ink drained per unit time in accordance with the temperature of the ink.

Although the above embodiment may be configured such that the drainage-pump control unit 65 controls the driving of the drainage pump 17 during the drainage operation so that the pressure detected by the pressure sensor 18 is lower than the meniscus withstanding pressure P, the drainage-pump control unit 65 may alternatively control the driving of the drainage pump 17 with a predetermined pressure lower than the meniscus withstanding pressure P without the use of the pressure sensor 18.

This predetermined pressure may be set in the following manner. The drainage pump 17 is driven in a state where the menisci are vibrated, and a pressure that causes the menisci to break is preliminarily estimated. The predetermined pressure is then set to a value smaller than or equal to the estimated pressure that causes the menisci to break. The drainage pump 17 is driven so that the amount of ink supplied per unit time is an amount that makes the pressure in the ink equal to this predetermined pressure. In this case, the drainage pump 17 is driven on the basis of, for example, the input power (electric current), the rotation speed of the pump shaft, and a flowmeter. Moreover, an adjustment based on temperature may be added to these driving conditions.

In addition, although the pressure sensor 18 may be positioned at the ink supply tube 31*a* in the above embodiment, a pressure sensor may alternatively be positioned within the reservoir unit 3. In that case, the pressure sensor may be capable of directly detecting the pressure of the ink in the ink inflow channel 43.

Although embodiments have been described in detail herein, the scope of this patent is not limited thereto. It will be appreciated by those of ordinary skill in the relevant art that various modifications may be made without departing from the scope of the invention. Accordingly, the embodiments disclosed herein are exemplary, and are not limiting. It is to be understood that the scope of the invention is to be determined by the claims which follow.

What is claimed is:

1. A recording apparatus comprising:

a channel unit comprising a pressure chamber configured to store a liquid to be ejected, and nozzles configured to eject the liquid;

a reservoir unit connected to the channel unit and comprising a supply port to which the liquid is supplied from an outside, a drain port from which the liquid is drained to the outside, a supply channel communicating with the channel unit, and a drainage channel branching off from the supply channel and communicating with the outside via the drain port;

a plurality of actuators configured to apply pressure to the liquid in the pressure chamber;

a meniscus vibrator configured to drive the actuators to vibrate meniscus produced in the nozzles without causing liquid droplets to be ejected therefrom when the liquid supplied from the supply port is being drained from the drain port after traveling through the supply channel and the drainage channel;

a drain valve configured to open and close the drain port;

a pump configured to drain the liquid from the drain port when the drain port is opened by the drain valve;

a temperature detector configured to detect the temperature of the liquid; and a pump controller configured to control the pump such that a flow rate of the liquid drained from the drain port to the outside per unit time is reduced as the temperature detected by the temperature detector increases.

2. The recording apparatus according to claim 1, wherein the meniscus vibrator configured to drive the actuators to vibrate meniscus produced in all the nozzles without causing liquid droplets to be ejected therefrom.

3. The recording apparatus according to claim 1, wherein the meniscus vibrator is configured to drive the actuators to vibrate meniscus produced in the nozzles without causing liquid droplets to be ejected therefrom when the drain port is opened by the drain valve.

4. The recording apparatus according to claim 1, wherein the pump is configured to cause the liquid to be enforcedly supplied from the supply port.

5. The recording apparatus according to claim 1, wherein the pump is configured to cause the liquid to be enforcedly drawn into the drain port by suction.

6. The recording apparatus according to claim 1, further comprising:

a liquid supply source configured to supply the liquid to the supply port;

a communication channel through which the liquid supply source and the supply port communicate with each other; and a pressure sensor configured to measure the pressure of the liquid in at least one of the communication channel and the supply channel, wherein the pump controller configured to control the pump such that the pressure of the liquid measured by the pressure sensor is equal to a predetermined pressure that is lower than a pressure that causes the meniscus to break.

7. The recording apparatus according to claim 1, wherein the supply channel comprises a filter configured to catch foreign matter contained in the liquid.

8. The recording apparatus according to claim 7, further comprising a filter chamber that is divided into an upstream liquid chamber and a downstream liquid chamber by the filter, the upstream liquid chamber being positioned closer towards the supply port and the downstream liquid chamber being positioned closer towards a common liquid channel, and wherein the drainage channel communicates with the upstream liquid chamber.

9. The recording apparatus according to claim 8, wherein the filter chamber extends in an extending direction of the reservoir unit, and wherein one end of the upstream liquid chamber in the extending direction communicates with the supply port and another end of the upstream liquid chamber in the extending direction communicates with the drainage channel.

10. A recording apparatus comprising:

a channel means comprising a pressure chamber for storing a liquid to be ejected, and nozzles for ejecting the liquid;

a reservoir means connected to the channel means and comprising a supply port to which the liquid is supplied from an outside, a drain port from which the liquid is drained to the outside, a supply channel communicating with the channel means, and a drainage channel branching off from the supply channel and communicating with the outside via the drain port;

a plurality of actuators for applying pressure to the liquid in the pressure chamber;

a meniscus vibrating means for driving the actuators to vibrate meniscus produced in the nozzles without causing liquid droplets to be ejected therefrom when the liquid supplied from the supply port is being drained from the drain port after traveling through the supply channel and the drainage channel;

drain valve means for opening and closing the drain port;

pump means for draining the liquid from the drain port when the drain port is opened by the drain valve;

temperature detecting means for detecting the temperature of the liquid; and control means for controlling the pump such that a flow rate of the liquid drained from the drain port to the outside per unit time is reduced as the temperature detected by the temperature detector increases.

11. An inkjet printer comprising:

a feed unit configured to feed a sheet;

a discharge unit configured to discharge the sheet;

a conveying mechanism configured to convey the sheet from the feed unit towards the discharge unit; and an inkjet head comprising:

a channel unit comprising a pressure chamber configured to store a liquid to be ejected, and nozzles configured to eject the liquid;

a reservoir unit connected to the channel unit and comprising:

a supply port to which the liquid is supplied from an outside, a drain port from which the liquid is drained to the outside, a drain valve configured to open and close the drain port;

a pump configured to drain the liquid from the drain port when the drain port is opened by the drain valve; and a supply channel communicating with the channel unit, and a drainage channel branching off from the supply channel and communicating with the outside via the drain port; a plurality of actuators configured to apply pressure to the liquid in the pressure chamber;

a meniscus vibrator configured to drive the actuators to vibrate meniscus produced in the nozzles without causing liquid droplets to be ejected therefrom when the liquid supplied from the supply port is being drained from the drain port after traveling through the supply channel and the drainage channel;

a temperature detector configured to detect the temperature of the liquid; and a pump controller configured to control the pump such that a flow rate of the liquid drained from the drain port to the outside per unit time is reduced as the temperature detected by the temperature detector increases.

* * * * *